United States Patent [19]

Motta

[11] 4,271,871

[45] Jun. 9, 1981

[54] WOVEN SLIDE FASTENER, METHOD AND APPARATUS FOR ITS MANUFACTURE

[75] Inventor: Carmelo Motta, Milan, Italy

[73] Assignee: Fastex s.r.l., Monza, Italy

[21] Appl. No.: 953,952

[22] Filed: Oct. 23, 1978

Related U.S. Application Data

[60] Division of Ser. No. 728,733, Sep. 30, 1976, which is a continuation of Ser. No. 557,272, May 14, 1975, abandoned.

[30] Foreign Application Priority Data

May 14, 1974 [IT] Italy ..... 22681 A/74
Dec. 6, 1974 [IT] Italy ..... 30272 A/74

[51] Int. Cl.[3] ..... D03D 41/00
[52] U.S. Cl. ..... 139/384 B; 139/35
[58] Field of Search ..... 139/35, 116, 118, 384 B; 24/205.13 C, 205.16 C

[56] References Cited

U.S. PATENT DOCUMENTS

| | | | |
|---|---|---|---|
| 3,022,803 | 2/1962 | Berberich et al. | 139/384 B |
| 3,266,114 | 8/1966 | Gerlach et al. | 24/205.16 C |
| 3,765,457 | 10/1973 | Glindmeyer et al. | 139/35 |
| 3,880,203 | 4/1975 | Frohlich | 139/116 |
| 3,961,652 | 6/1976 | Hasuda et al. | 139/384 B |

*Primary Examiner*—Henry Jaudon
*Attorney, Agent, or Firm*—Cushman, Darby & Cushman

[57] ABSTRACT

A woven slide fastener is described consisting of two supporting tapes having a two-arm edge carrying a row of linking elements formed of a synthetic monofilament, the arms of the edge of each supporting tape converging at the point of insertion of the linking elements. There are further described a method and an apparatus for the manufacture of the tapes used in the slide fastener consisting in the use of a core around which the monofilament is bent so as to obtain a meander configuration during the manufacture of the woven supporting tape.

10 Claims, 42 Drawing Figures

Figure 1:
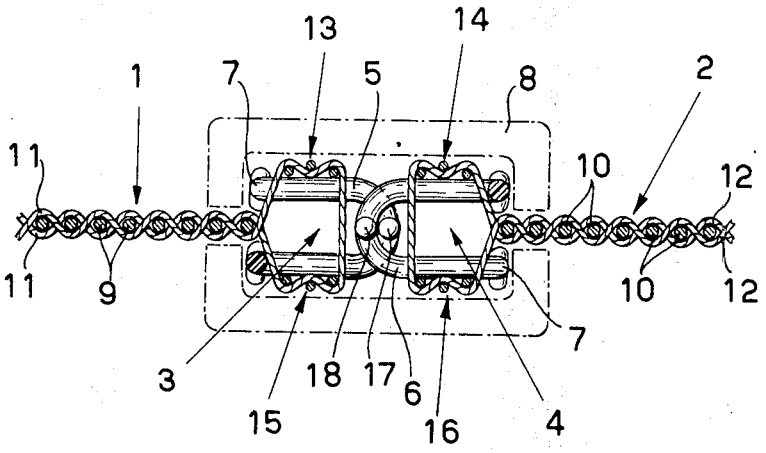

1
2
3
4
5
6
7
8
9
10
11
12
13
14
15
16
17
18
19
20
21
22
22a
23
23a
24
25
26
27
27a
28
30
30a
31·33
32
34·36
35

Fig. 21
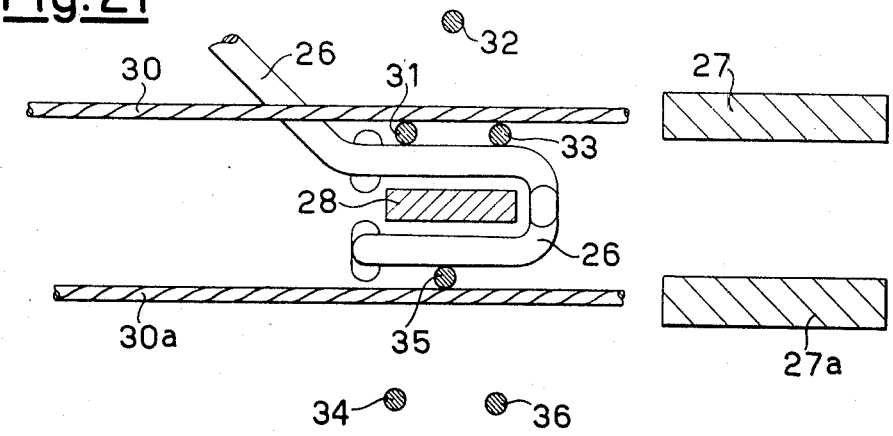
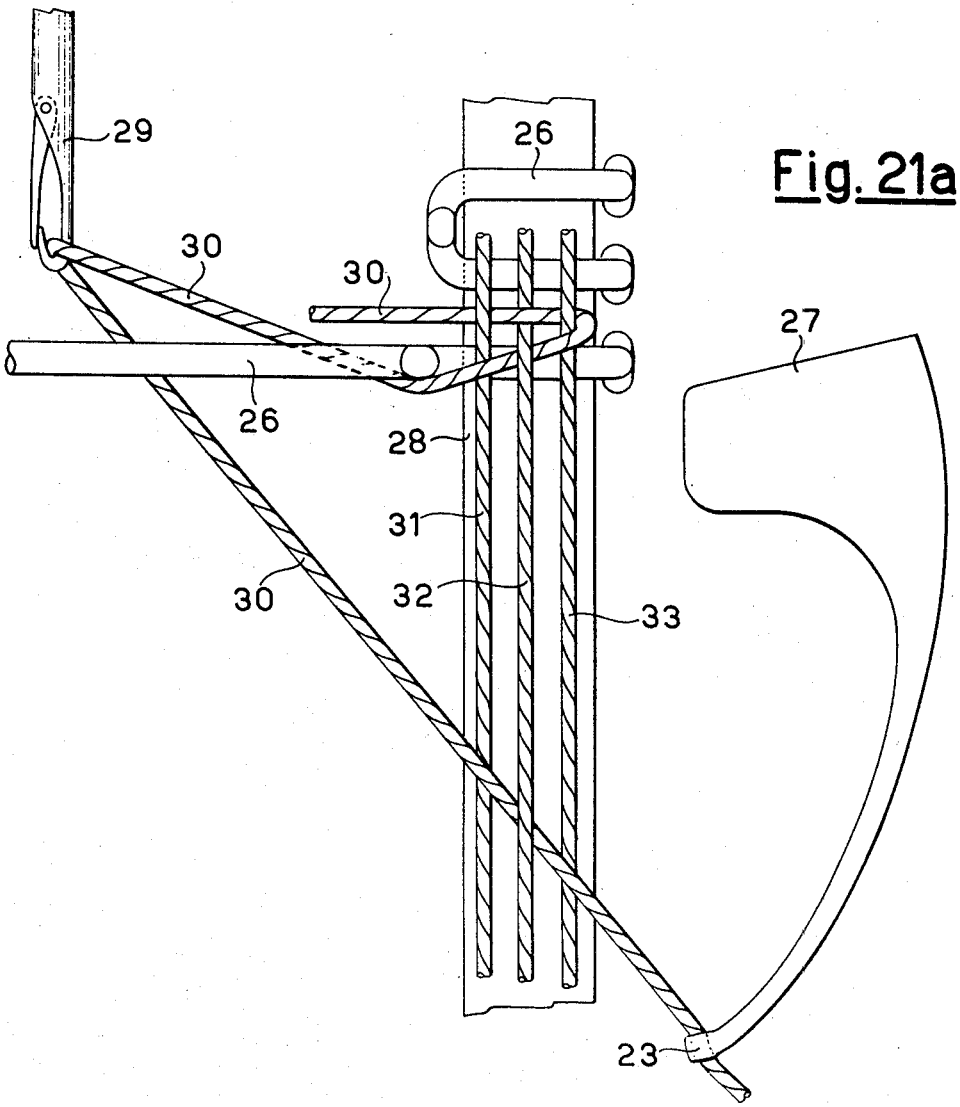
Fig. 21a

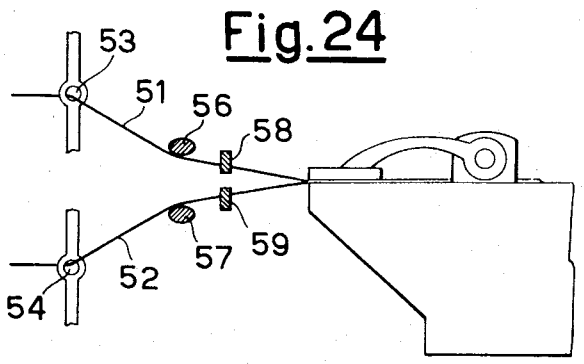
Fig.24
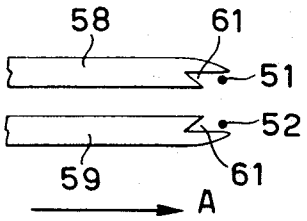
Fig.23
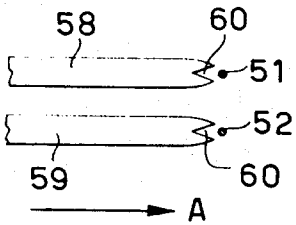
Fig.22
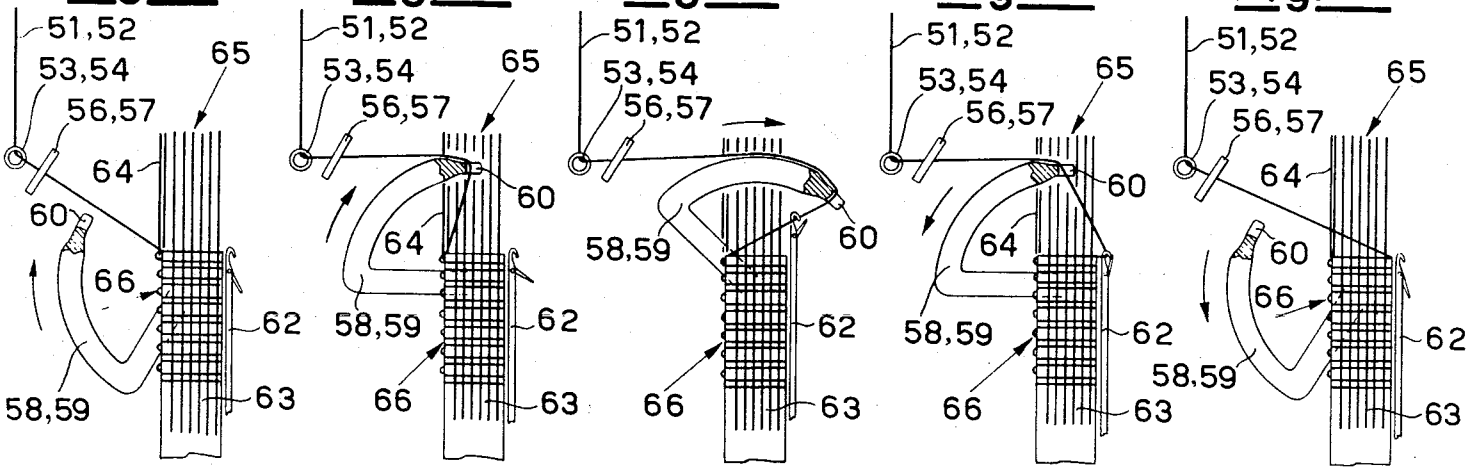
Fig.29
Fig.28
Fig.27
Fig.26
Fig.25

WOVEN SLIDE FASTENER, METHOD AND APPARATUS FOR ITS MANUFACTURE

This is a division of application Ser. No. 728,733, filed Sept. 30, 1976 which is a continuation of application Ser. No. 557,272, filed May 14, 1975, now abandoned.

The present invention relates to a woven slide fastener and also to a method and apparatus for its manufacture. The woven slide fastener according to the invention is of the type having supporting tapes for rows of linking elements of meander conformation which are formed simultaneously with the weaving of the supporting tapes.

There are already known woven slide fasteners in which the two rows of linking elements are pre-formed and then secured to the respective supporting tapes by means of and during the weaving of the said tapes. The rows of linking elements are obtained from a synthetic monofilament having a somewhat large cross-section.

According to other known methods, the rows of linking elements are, as well as being secured to the supporting tapes, directly formed during the weaving of said tapes, and in this way the pre-forming operation is eliminated.

Some of these other known methods can only be actuated on looms with two shuttles, one of which carries the synthetic monofilament for the formation of the row of linking elements, while the other shuttle carries the weft yarn which secures the said row of linking elements to the supporting tape. Another known method can, on the other hand, be actuated also on so-called high-speed looms, i.e. needle looms having a high number of picks per minute (even more than a thousand).

According to this method, the synthetic monofilament destined to form the row of linking elements of each supporting tape is fed as warp thread during the weaving of a Y-tape and is secured in a fluctuating manner alternately to one and to the other of the two short arms of the Y-tape. At a stage subsequent ot the weaving of the tape and the securing of the monofilament to the short arms thereof, the fluctuating sections of the monofilament between the two short arms have to be bent and heat-set for the definitive forming of the meander of the row of linking elements. Owing to the exigencies inherent in this method, the short arms of the Y-tape must have a length such as to continue towards their point of convergence even after the insertion point of the linking element.

This circumstance gives rise to difficulties of various kinds. In fact, in order to be able to assemble the slide fastener, it is necessary to fit the slide over the rows of linking elements of the two supporting tapes; this fitting of the slide, whether carried out at the top without removal of an area of linking elements, whether made after removal of a certain section of linking elements, causes considerable difficulties.

The two short arms of the Y-tape, unless particular expedients are adopted, cannot except with great difficulty be passed through the tape-passages provided on the slide.

Furthermore, the particular Y-conformation in question, having a considerable double-fabric area, renders the support tape particularly heavy and therefore costly.

Another drawback of this method lies in the fact that the formation of the head of the teeth and the definitive forming in meander conformation of the row of linking elements are foreseen, as already mentioned, as taking place by means of an operation performed after the weaving, to be done on the loom, which operation is particularly delicate.

The purpose of the present invention is therefore to create a slide fastener which, although preserving the advantages of the slide fasteners obtained according to the aforesaid method, eliminates its defects—arising mainly from the Y-shaped support tape with short arms extending beyond the insertion area of the row of linking elements.

The said purpose is achieved, according to the present invention, with a woven slide fastener comprising two supporting tapes, each consisting of a textile plait presenting a two-arm edge which carries a row of linking elements formed by a meander of continuous synthetic monofilament secured by means of weaving to the edge of the respective tape, with the U-loops uncovered by the fabric, said slide fastener being characterized by the fact that the two arms of the edge of each supporting tape converge at the point of insertion of the linking elements of continuous synthetic monofilament.

The two arms of the edge can form part of a tubular textile plait, but can also constitute the short arms of a Y-shaped textile plait. In this latter case, the short arms can be formed from the plaiting of a certain number of warp threads with the weft, constituting an upper and lower covering for the linking elements; if so wished, however, it is also possible to do without the covering warp threads, in practice reducing the short arms to loops of weft threads which bind together around the base of each leg of the U-loops of the meander.

The internal space of the edge can if wished be padded with threads, pledgets, monofilaments or any other material.

The slide fastener according to the invention preserves the advantageous characteristic of being able to have the meander row of linking elements on each supporting tape in part covered and protected by the fabric, with the U-loops of the meander uncovered so as to provide the slide with an ideal sliding surface.

As, however, the part of the tape immediately external to the meander is not in the present instance formed from a double fabric (inasmuch as there is no continuation of the two arms of the edge beyond the point of insertion of the linking elements), this part of the tape has considerable less thickness and can easily be placed into the respective passage on the slide, which passage can also be narrow, with every advantage for the lateral thrust capacity of the slide against the linking elements.

The possible use of a loom with two weft-picking needles in the present case preserves the positive aspect of allowing a double production-rate, whereas it does not imply the result of a heavier tape with the related high costs due to the increase in weight.

The method of manufacture of the slide fastener according to the invention provides for the use of a synthetic monofilament precrimped at regular intervals, which monofilament is fed as warp thread and is woven and bound into the two-arm edge of a supporting tape during the weaving thereof, it being simultaneously bent around a core temporarily or permanently inserted into said edge so as to obtain directly also its final meander configuration.

The bending of the monofilament around the said core is performed at the points of pre-crimping of the said monofilament, by bringing this latter, in a predetermined sequence, alternately to opposite sides of the shed.

When operating with one weft thread only, it is necessary to cause this to pass once over and once under the aforesaid core, and this can be done by bringing the core also, in a pre-determined sequence, alternately to opposite sides of the shed, so that periodically the monofilament finds itself on one side, and the core on the opposite side, of the shed. The bending of the monofilament is then completed by the reed during the beating of the weft after every change of position of the monofilament and of the flexible core with respect to the shed.

When operating with two weft threads, on the other hand, their action during the picking movement and a calculated ratio between the tensions of these threads and the tension of the monofilament contribute together to form the meander. Advantageously, to the end of increasing dependability, provision can be made for special elements suitable for completing the bending of the monofilament around the core after each weft pick. In the case of a shuttle-loom, these elements can be applied for example to the shuttles themselves or to any moved support for example by the same mechanism as drives the shuttles.

In the event of use being made of a two-needle or a two-sickle weft-picking loom, the said elements can be embodied by means of a particular configuration of the needles. In any case, the aforesaid bending elements are endowed with reciprocal movement in synchronism with the movement of the weft-picking organs (needles or shuttles) and are guided so as to follow trajectories that substantially correspond to those of the weft-picking organs. They act on the synthetic monofilament to complete its bending around the core immediately after the picking of the weft threads.

The method according to the invention can also be actuated by using two weft threads which work in different weaving planes, and, by inverting—in a predetermined sequence—the position of these two weft threads from one to the other of the said weaving planes. When operating in this manner it is also possible to obtain a tape with tubular edge, which is however formed by means of the picking of two weft threads at a time.

The apparatus which is used for the manufacture of the slide fastener according to the invention consists of a weaving loom suitable for manufacturing tapes and provided with means for the feeding of a synthetic monofilament as warp thread, of a core which extends in parallel fashion to the direction of the warp threads for at least a certain section above the loom weaving bench in the area of the edge of the tape into which will be inserted the linking elements, and also consisting of means suitable for bringing in a pre-determined sequence, the said synthetic monofilament alternately to opposite sides of the shed.

The core around which the monofilament is bent in order to assume the desired meander configuration can be realized in any material: it can, by way of example, consist of a thin steel lamina or also of a wire of any material of appropriate thickness. In the case where the edge of the tape has to take on a tubular form and where operation are performed with a single weft thread, the core must possess an adequate flexibility and flex life to bear the repeated bendings to opposite sides of the shed. Such shifting can be achieved by connecting a support-member of the rear extremity of the core to a heddle of the loom such as is suitable for controlling the movement from one side of the shed to the other. This control, however, can also be performed with other appropriate means extraneous to the normal organs of the loom.

When it is not intended that the core shall remain definitively inside the meander, it can be secured to its support-member.

If operations are performed with two weft threads and with inversion thereof from one weaving plane to the other, this inversion can take place after every pick, or, for example, on any every-other pick basis.

In the first case a tape is manufactured with normal tubular edge, while in the second case a tubular edge is always formed, but whenever provision is not made for inversion of the weft threads, these threads form a loop around the synthetic monofilament and any covering threads, by turning back towards the binding needle.

The method providing for the inversion, in a pre-established sequence, of two weft-threads, can be actuated on a loom with two special weft picking needles or sickles. The peculiarity of these needles or sickles lies in the fact that, instead of having at their extremities an eye through which the related weft thread passes, they are so shaped as to retain, during the picking movement only, the respective weft thread presenting itself in their trajectory, then leaving such thread free towards the completion of their return movement. In other words, the picking needles do not retain the weft threads in a continuous manner, but retain them only during the picking movement.

In this way it is possible, by means of simple expedients, to present in the desired sequence a weft thread once in the trajectory of one needle and once in the trajectory of the other needle. This diverse positioning of the weft threads can be obtained in the simplest way, by causing them to pass through the eyes of two heddles which are so controlled as to move in the desired sequence.

The extremities of the needles which have to grip the weft threads can have, for example, a simple slot suitable for receiving the related thread in order to convey it in the picking movement.

The invention will hereafter be described in greater detail with reference to the attached drawings which illustrate, by way of example and not restrictively, in schematic form, some forms of slide fasteners according to the invention and apparatuses for their production.

Figure 2:
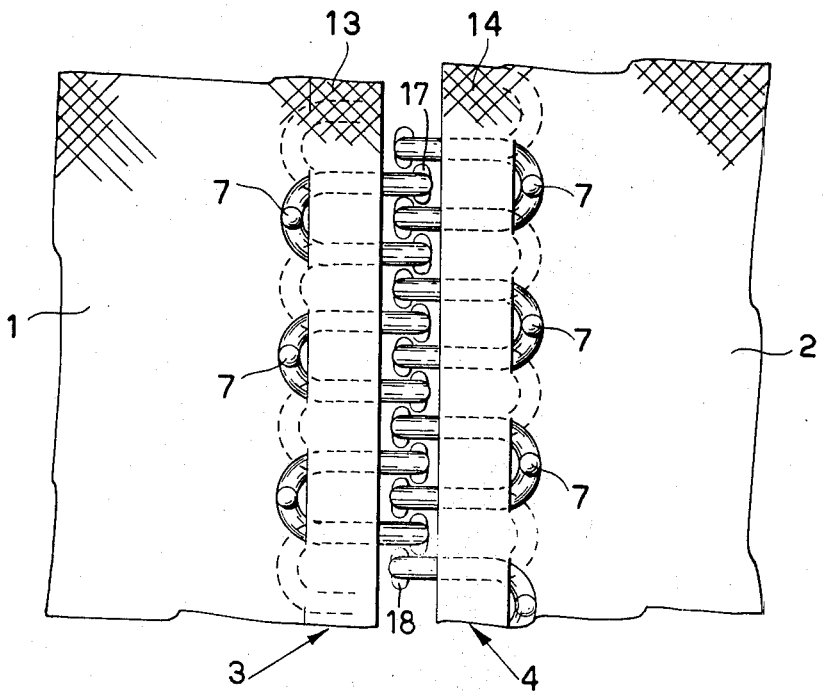

The FIG. 1 shows schematically a form of execution of the slide fastener, in cross section, with supporting tapes having tubular edge;

the FIG. 2 is a plan view of the same slide fastener; the

Figure 3:
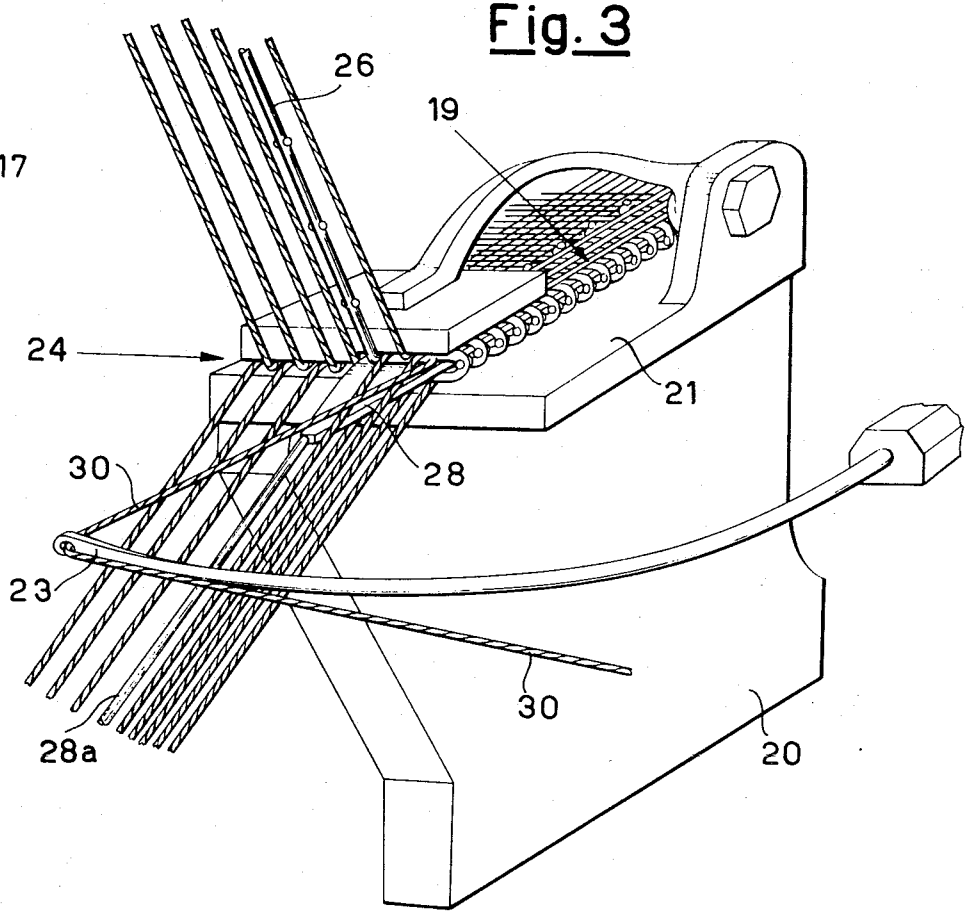
Figure 2A:
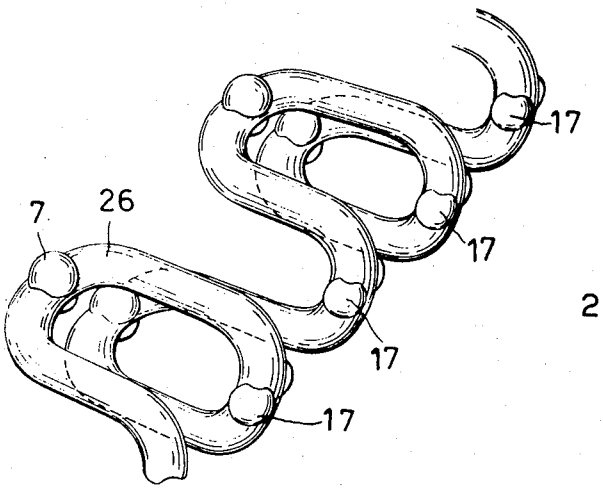
Figure 4:
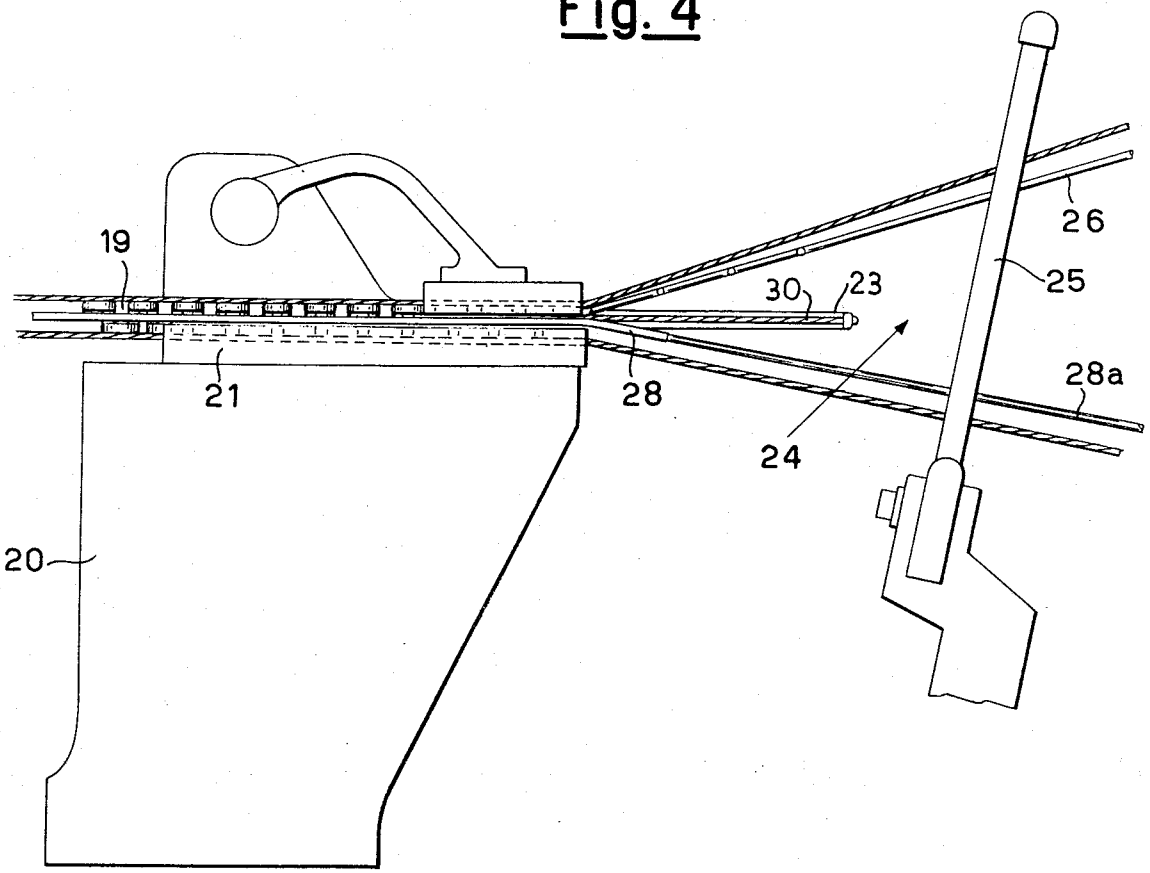
Figure 5:
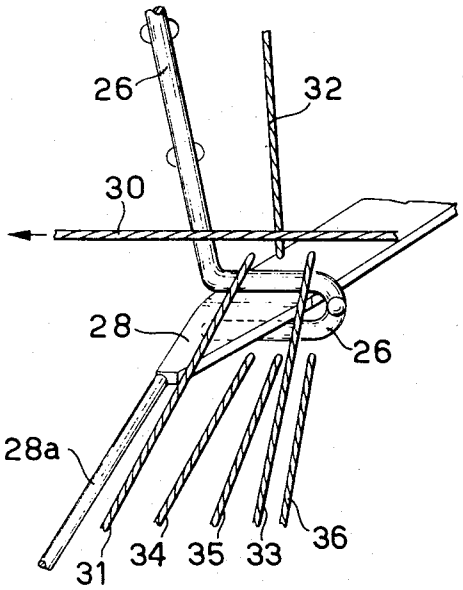
Figure 11:
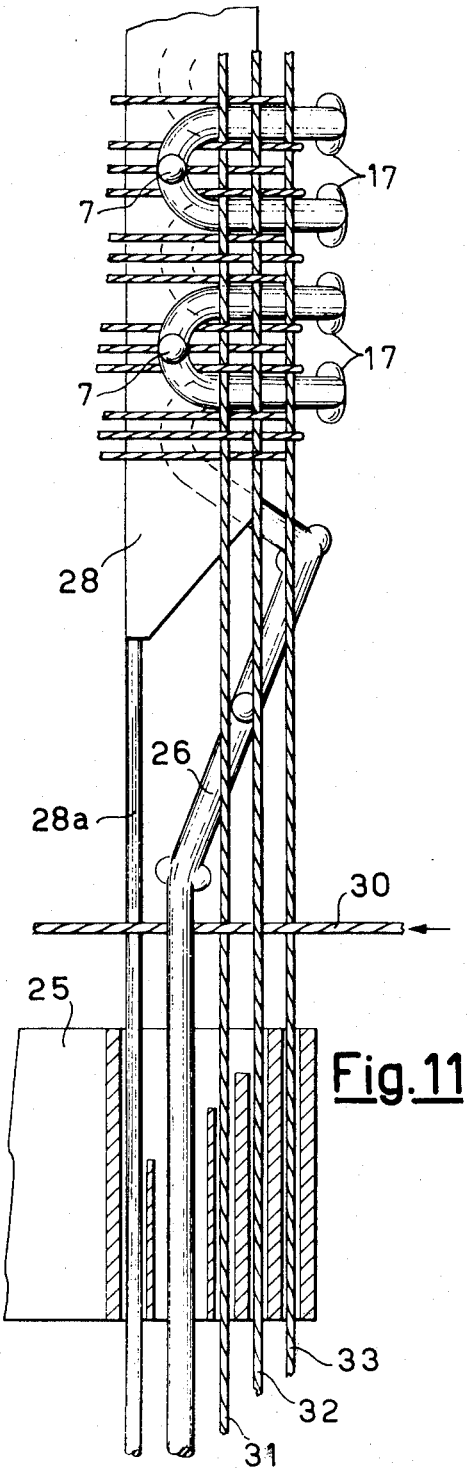
Figure 12:
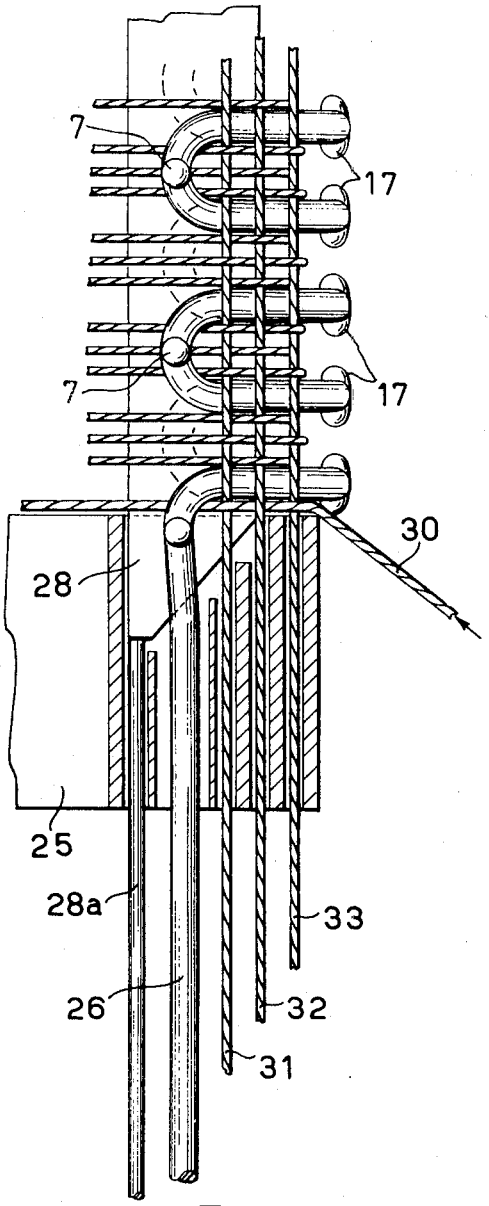
Figures 13, 15:
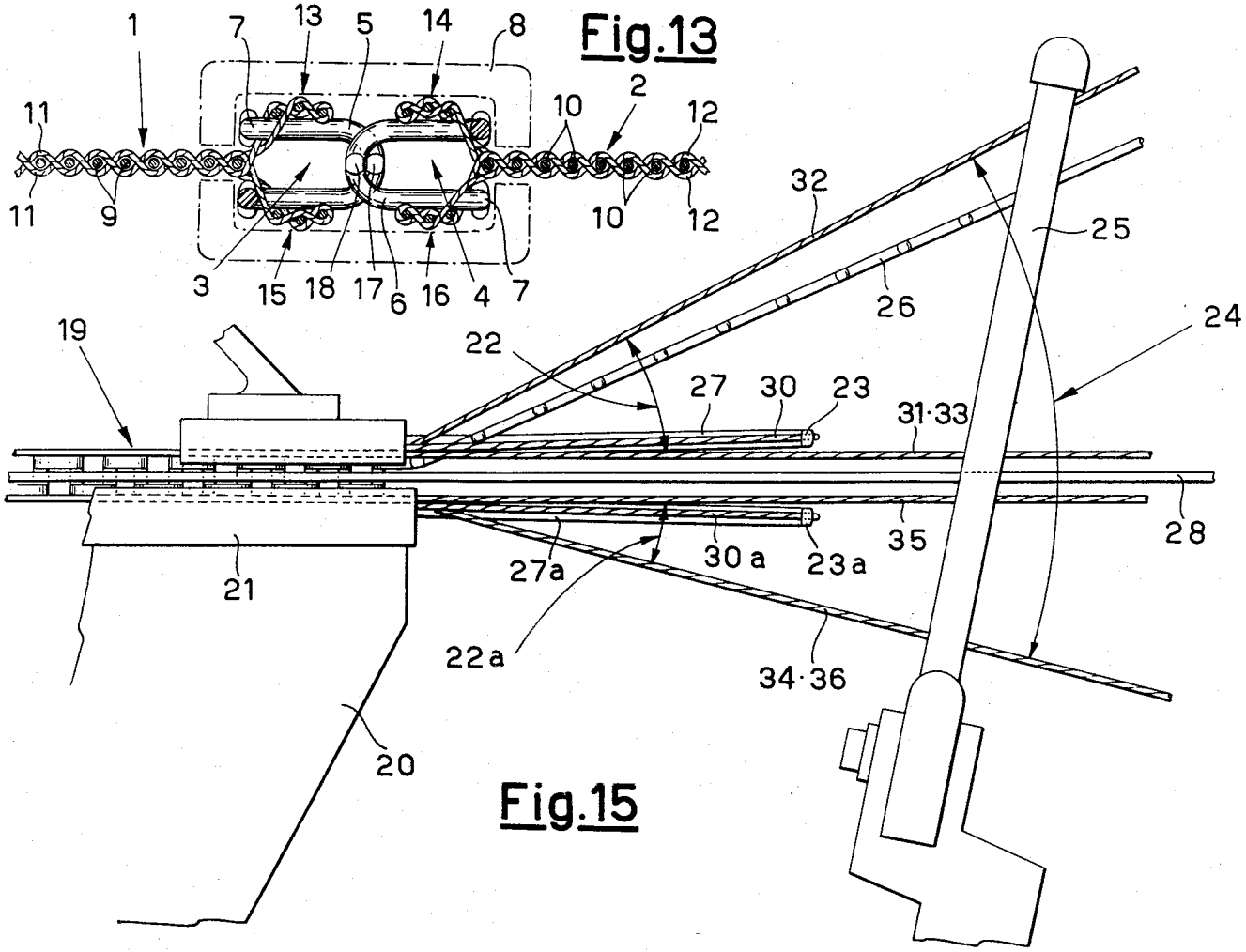
Figure 14:
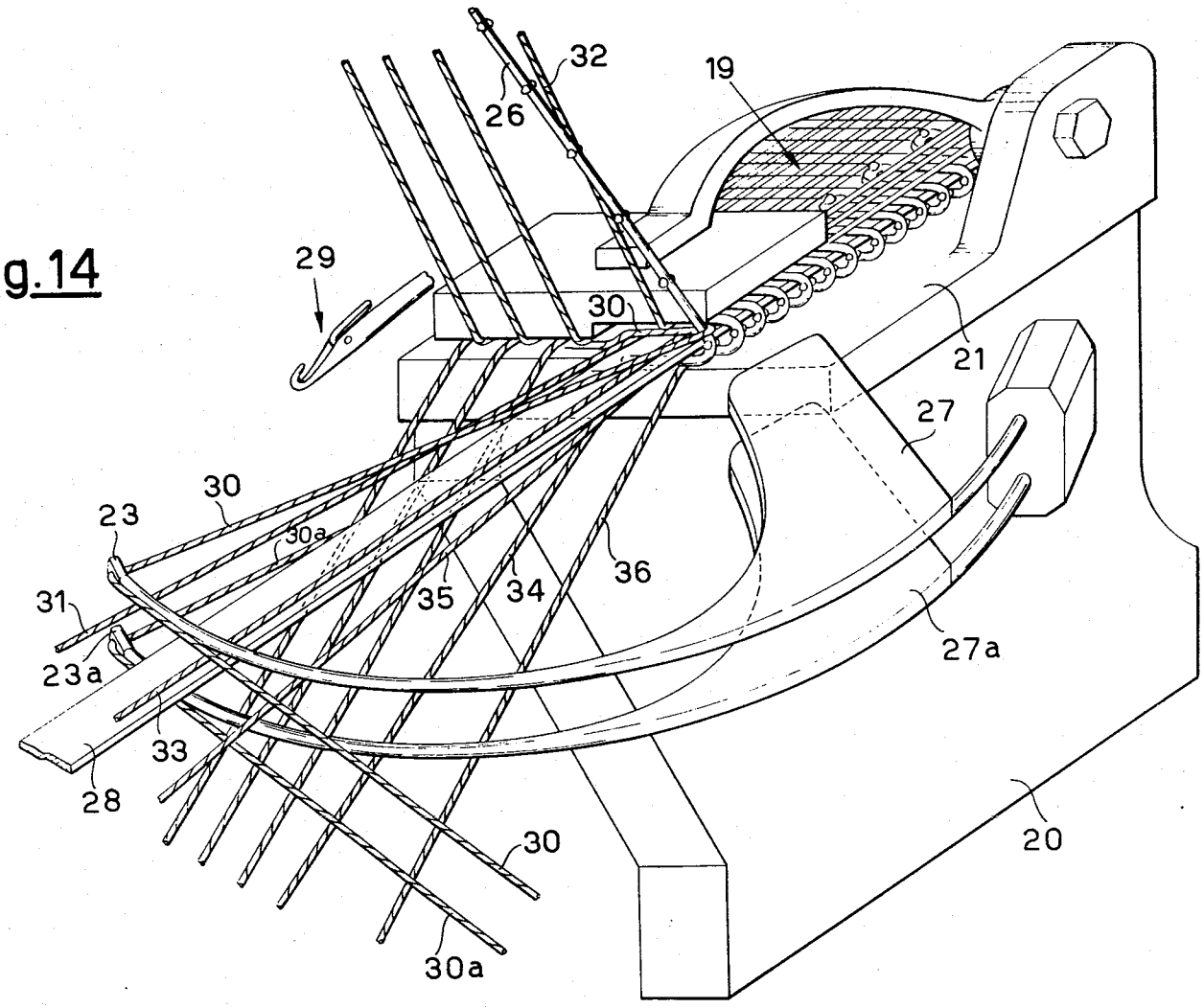
Figure 16:
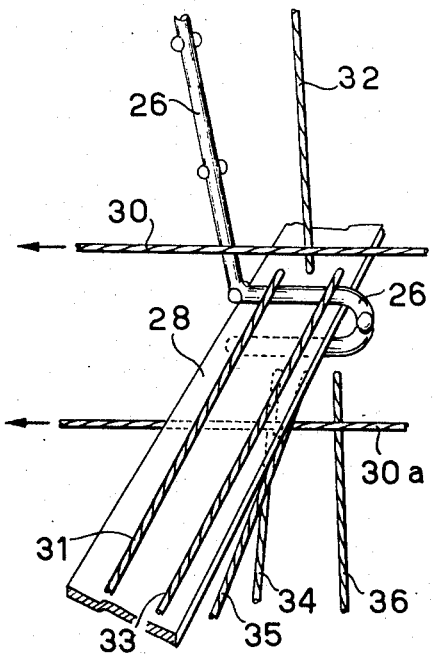
Figure 17:
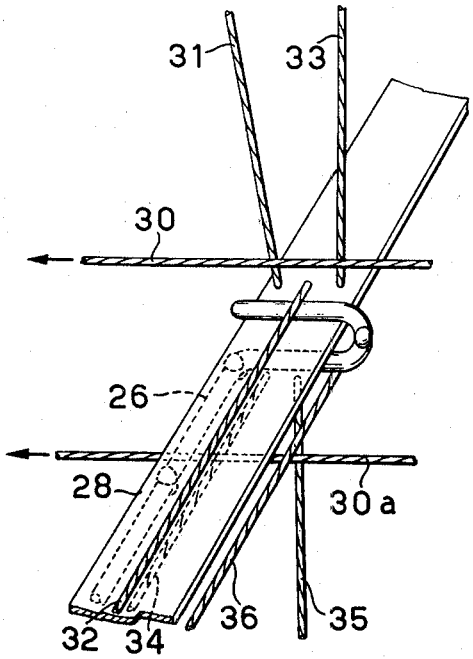
Figure 16A:
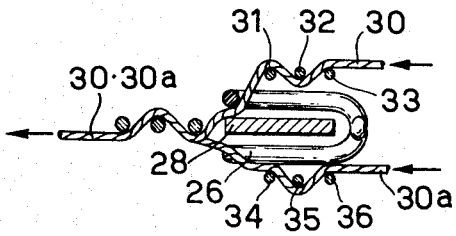
Figure 17A:
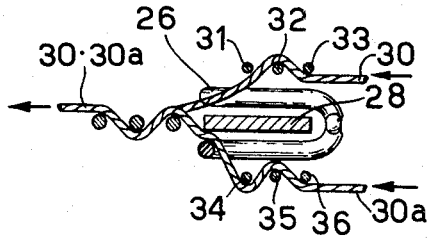

FIG. 2*a* shows, in perspective, only the monofilament bent in meander conformation;

the FIG. 3 is a schematic perspective view of an apparatus suitable for realizing the slide fastener according to the FIG. 1;

the FIG. 4 is a lateral schematic view of the same apparatus;

the FIGS. from 5 to 10 show schematically the position of the warp threads for the formation of the tubular edge and the position of the monofilament and of the core at the moment of the picking of the weft, in subsequent operational steps;

the FIGS. from 5*a* to 10*a* are corresponding schematic cross sections (weft profiles);

the FIGS. 11 and 12 are plan views corresponding to the operational steps according to the FIG. 5, respectively prior to and at the moment of the beating of the weft by the reed;

the FIG. 13 shows, similarly to the FIG. 1, another form of execution of the slide fastener with supporting tapes having edges consisting of two short arms;

the FIG. 14 is a schematic perspective view of an apparatus for the realization of the slide fastener according to the FIG. 13;

the FIG. 15 is a lateral schematic view of the apparatus according to the FIG. 14;

the FIGS. 16 and 17 show schematically the position of the covering warp threads for the formation of the edge having tow short arms, in one of the possible examples of execution, and the position of the monofilament with respect to the lamina at the moment of the picking of the wefts, in two subsequent operational steps;

the FIGS. 16*a* and 17*a* are corresponding schematic cross sections (weft profiles);

the FIGS. from 18 to 21 illustrate schematically, in cross section, successive instants of the weft picking movement and of the action of bending the monofilament, corresponding to the operational step according to the FIG. 16;

the FIGS. from 18*a* to 21*a* are corresponding plan views; the FIGS. 22 and 23 show two exemplifying forms of weft picking needles utilizable in the event of operations being performed with inversion of the wefts;

the FIG. 24 is a lateral schematic view of a weaving loom adapted for working with inversion of the wefts;

and the FIGS. from 25 to 29 illustrate in plan view the operational method with inversion of the wefts in five subsequent operational steps.

With reference to the FIGS. 1 and 2, there is shown a possible form of realization of the slide fastener according to the invention.

This slide fastener comprises two woven supporting tapes 1 and 2 which each have a tubular edge, 3 and 4 respectively, into which is inserted and to which is bound by means of weaving a continuous row of linking elements, 5 and 6 respectively, consisting of a mono-filament of meander conformation, the U-loops of which, formed at the pre-crimped points of the monofilament which are indicated by 7, are uncovered so as to provide an ideal surface for sliding and for lateral thrust against the slide 8, indicated schematically in the FIG. 1 with dashed and dotted lines.

The supporting tapes 1 and 2 are each formed with an appropriate number of warp threads 9 and 10 respectively, depending on the width it is desired that the said tapes should have. The textile plait with the weft threads 11 and 12 respectively, can be chosen at will. Further warp threads constitute, on both faces, and external covering; indicated by 13, 15 and 14, 16 respectively, of the monofilament in meander conformation, 5 and 6 respectively, the functions of which warp threads are both to contribute to the securing of the monofilament to the related supporting tape and to conceal from view the monofilament itself and to protect it from possible damage.

As can be clearly seen from the FIGS. 1 and 2, however, the said covering leaves free both the external part of the lateral U-loops of the meander shaped monofilament and the linking elements proper formed at the other pre-crimping points, as at 17 and 18 respectively, of the monofilament.

The number of warp threads forming the said covering is a also chosen at will, and is not to be understood as limited to three per side as indicated by way of example in the FIG. 1.

As is clearly seen in the FIG. 1, the said warp threads making up the upper covering 13, 14 and the lower covering 15, 16 of the meander shaped monofilament are also plaited with the weft and form the tubular edge of the respective supporting tape.

The two supporting tapes 1 and 2, with the related rows of linking elements 5, 6 which, together with the slide 8, form the slide fastener, are identical one to the other, so that the following description of the method and of the apparatus for their production can refer to only one of them.

The apparatus consists substantially of a normal weaving loom suitable for producing tapes, in the present case tapes with tubular edge in particular.

This loom can be of the type having a shuttle for the picking of the weft or can be, advantageously, a loom of the type having a needle for the picking of the weft.

The description that follows refers to this last-mentioned type of loom, some of the principle organs of which are illustrated in a purely schematic form in the FIGS. 3 and 4.

It is in any case understood that the loom can be realized in any form known to the art, and that the organs and mechanisms which are not illustrated in the drawing can correspond to the conventional and well known ones.

The body 20 of the loom carries on its upper part the weaving bench 21 on which the woven tape is formed, this being schematically indicated at 19, by means of textile plaiting of warp threads and one weft thread 30, this latter being picked by a needle 23 in the so-called shed, indicated at 24. A reed 25, through the gaps of which the warp threads pass, serves in known manner to beat the weft at the point of formation of the tape.

In the FIGS. 3 and 4 there can also be seen the synthetic monofilament 26 fed as warp thread, and the wire-shaped element 28*a* which carries the flexible core 28 (see FIGS. 5–12), which, in the form illustrated by way of example has the shape of a thin lamina with oblique edge at its rear extremity where the lamina is solid with its support wire 28*a*.

The monofilament 26 and the support wire 28*a* of the core 28 pass through adjacent gaps of the reed 25 (see FIGS. 11 and 12) and can be connected to heddles (not illustrated) of the loom for control of their movement, in a pre-established sequence as will appear from the description that follows, alternately to opposite sides of the shed 24.

This movement can be imparted, however, with any other suitable means also.

To assist in a better understanding of the method of manufacture of a slide fastener of the type illustrated in the FIGS. 1 and 2, there will hereafter be described, with reference to the FIGS. 5–12, certain stops relating to the formation of the tubular edge only of one of the supporting tapes with the simultaneous formation of the related row of linking elements starting from the synthetic monofilament 26.

It has already been stated that the monofilament must be precrimped prior to the weaving (but also on the loom itself) in order to facilitate its being bent around the lamina 28 and to keep the resulting dimension of the meander constant. Preferably, the precrimping is performed alternately, displaced by 90° with respect to the axis of the monofilament (as clearly shown in the FIGS. 11 and 12); inasmuch as the two bendings that the monofilament has to undergo in order to achieve the final meander form are in fact displaced by 90° with respect to the axis, the said bendings occurring alternately at the U-loops of the meander and at the linking elements or teeth (see FIG. 2*a*).

It should be noted that in the FIGS. from 5 to 12 there are indicated, at the edge of the supporting tape, three warp threads 31, 32, 33 destined to form the upper covering, and three warp threads 34, 35 and 36 destined to form the lower covering of the meander. These warp threads also contribute to forming the tubular part.

The FIGS. from 5*a* to 10*a* also indicate certain warp threads for the formation of the bottom of the supporting tape proper. It is understood, however, that the number of covering threads, as also the number of threads for the formation of the tape, and likewise the particular type of textile plaiting, can be selected and varied at will and depending on requirements.

In the operating step illustrated in the FIGS. 5, 5*a* and 11, the warp threads, the monofilament and the flexible core are disposed in the following manner: the thread 32 is on the upper side of the shed, while the threads 31, 33 and 34, 35 and 36 are on the lower side. With respect to the previous step (FIGS. 10 and 10*a*), the monofilament 26 has been brought from the lower side to the upper side, while the flexible core 28 has been taken from the upper side to the lower side of the shed. After the picking of the weft thread 30, the reed 25 advances towards the point of formation of the fabric (from the position as shown in FIG. 11 to that shown in FIG. 12).

Following on the change of position of the monofilament and of the flexible core with respect to the shed, and as a result also of the pre-crimping of the monofilament, this latter has undergone a slight bending around the core, a bending which is completed by the beating of the weft by the reed, so that the monofilament directly takes on the final meander form. The inclined plane of the core assists the monofilament in taking on this final form. In practice, the monofilament is bent back by 180° around the core.

Figure 7:
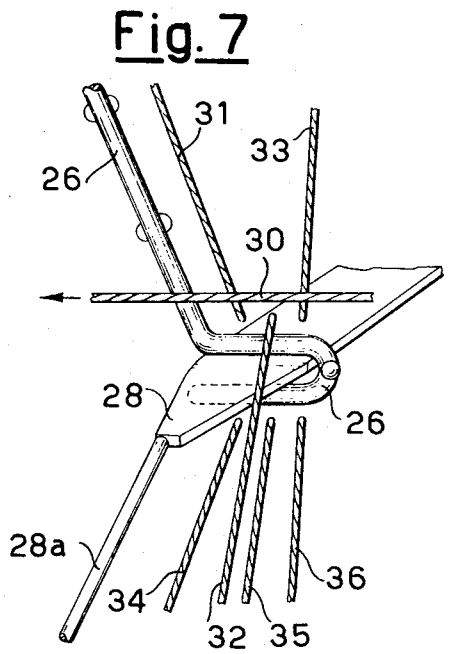
Figure 7A:
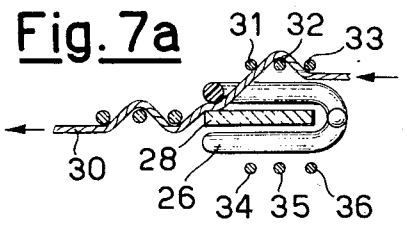
Figure 6:
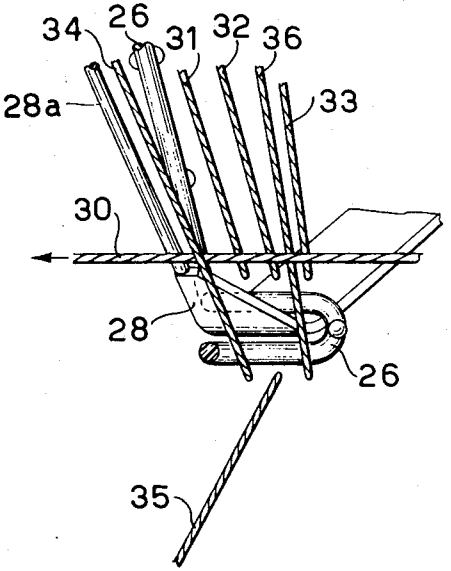
Figure 6A:
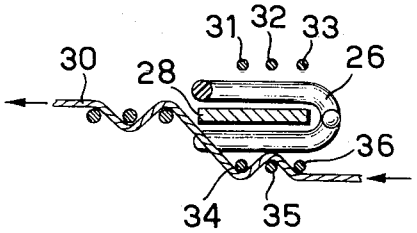

In the two following operating steps (FIGS. 6–6*a* and 7–7*a*), the monofilament 26 keeps its position with respect to the shed unchanged, while the flexible core 28 is first taken upwards (FIGS. 6–6*a*) and then again downwards (FIGS. 7–7*a*). The covering warp threads also change position, so that in the step according to FIGS. 6–6*a* all the covering threads except the thread 35 are on the upper side, whereas in the step according to FIGS. 7–7*a* all the threads except the threads 31 and 33 are on the lower side of the shed. These steps serve for the formation of the covering fabric and for the securing of the meander.

It needs also to be noted not only that the number of wefts pickable between tooth and tooth can be varied within broad limits (depending for example on the denier of the weft yarn employed), but also that it is possible, by varying such number of picked wefts, to modify within narrower limits the pitch itself of the meander.

Figure 8:
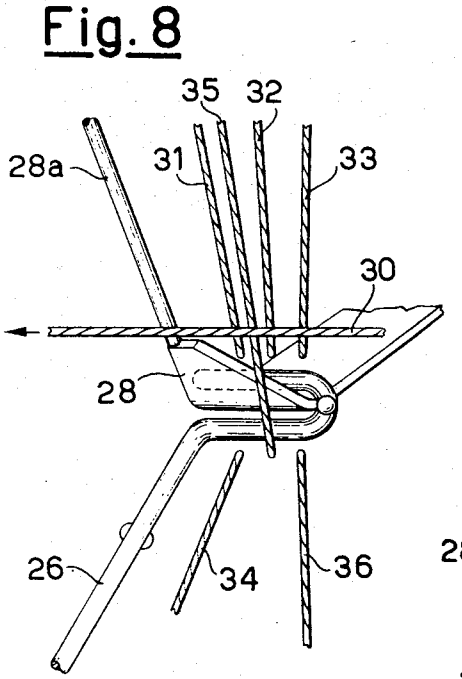
Figure 8A:
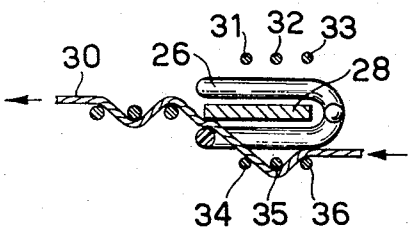

When progression is made from the step of the FIGS. 7–7*a* to the step of FIGS. 8–8*a*, the monofilament 26 and the core 28 again change the position: the monofilament is taken downwards and the core upwards, so that there is another 180° bending of the monofilament around the core with formation of one part of meander concomitantly with the beating of the weft. In this step, the covering warp threads 31, 32, 33 and 35 are at the upper side and the threads 34 and 36 at the lower side of the shed.

Figure 9A:
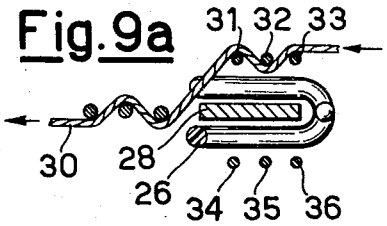

The subsequent two steps (FIGS. 9–9*a* and 10–10*a*) do not provide for any change of position of the monofilament, while the flexible core is first taken downwards and then upwards again. In the step of the FIGS. 9–9*a*, the covering threads, on the other hand, are all at the lower side, with the exception of the thread 32 and in the step of the FIGS. 10–10*a* are all at the upper side except for the thread 35.

Figure 5A:
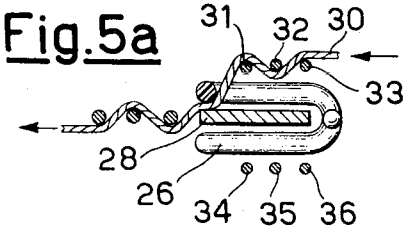
Figure 10:
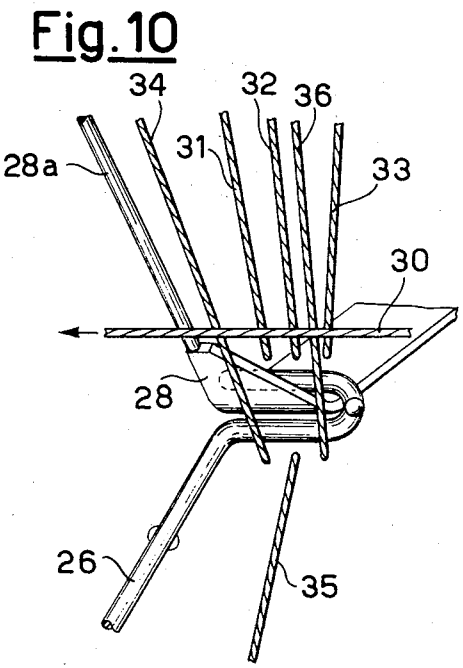
Figure 9:
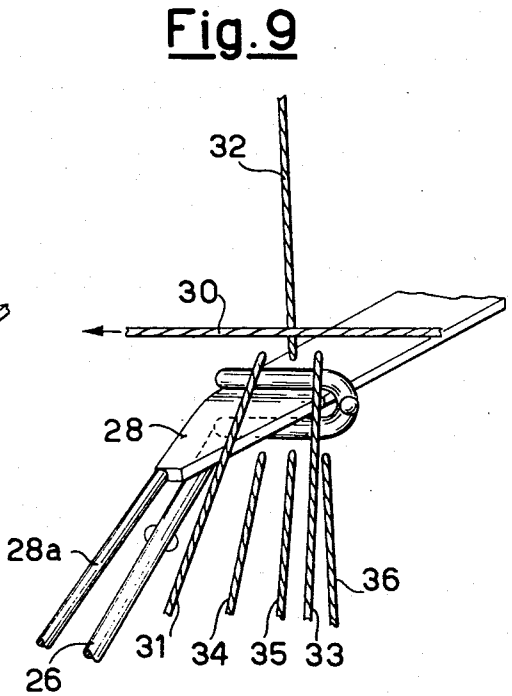
Figure 10A:
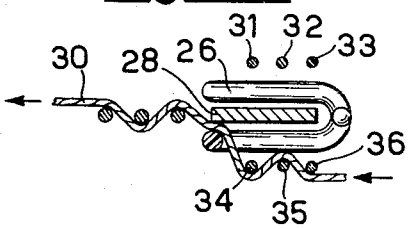

After the step of the FIGS. 10–10*a*, change is made to a step similar to that of the FIGS. 5–5*a* with change in the position of the monofilament and of the flexible core with respect to the shed and consequent further 180° bending of the monofilament and formation of a part of the meander. It should be noted that, for the purposes of the invention, no importance attaches to the evolutions of the threads which form the upper covering and the lower covering, nor to the evolutions of the threads making up the supporting tape, so that most attention should be given to the evolution of the monofilament 26 around the core 28.

A second exemplifying form of a slide fastener according to the invention is illustrated in FIG. 13, in which parts identical to those already described are indicated with the same reference numbers.

This type of slide fastener comprises two woven supporting tapes 1 and 2 which each have an edge, 3 and 4 respectively, with two short arms which constitute on both the faces the external covering, 13, 15 and 14, 16 respectively, of the monofilament of meander conformation.

The difference as compared with the first type of slide fastener lies in practice only in the fact that the two arms of the edge are not closed to form a tubular plait.

In this case, too, the number of warp threads forming the said short arms of the supporting Y-tapes can be selected at will and should not be understood as being limited to three per side as indicated by way of example in the FIG. 13; it is also possible for there to be no warp threads at all.

In the absence of such threads, in fact, and as can be inferred from the FIG. 13, the weft threads 11 and 12 respectively come simply to form a loop around the base of each leg of the U-loops of the monofilament.

If it is wished to obviate a possible inconvenience that might be caused because the short arms of the Y (when, clearly, the preserving of the covering warp threads is opted for), during the manufacturing steps (especially the finishing) or during the use of the slide fastener, go to the wrong side thus leaving the meander uncovered but in particular becoming blocked in the tape-passage of the slide, it is easily possible to bind the aforesaid two arms together for example by means of one or more warp threads which, by moving alternately between the highest position of the shed of the upper covering and the lowest position of the lower, and by positioning themselves in zig-zag fashion between the protruberances of the linking elements, in effect obviate the aforesaid inconvenience. The apparatus for realizing the slide fastener according to the FIG. 13 is similar to the one already described.

In this case, too, use can be made of a shuttle-loom or a needle-loom for the weft picking. The FIGS. 14 and 15 schematically illustrate a needle-loom which differs from the one already described in that it operates with two weft threads 30 and 30*a* (instead of with one only), these threads being picked by two needles 23 and 23*a* separately in the upper shed 22 and the lower shed 22*a* of the warp threads forming the two short arms of the supporting Y-tape and together in the single shed 24 of the warp threads forming the tape proper (see FIG. 15).

As can be noted in the FIG. 14, the needles 23 and 23*a* are each provided with a sector 27 and 27*a*, which sectors have the function, during the movement of weft thread picking on the part of the block featuring the two picking needles, of improving the bending of the pre-crimped monofilament 26 around the lamina 28.

The reed 25 serves in known manner to beat the weft at the point of formation of the tape.

The sequence of entry into the reed 25 to obtain the desired effect of meander formation will be, from left to right looking at the FIG. 14, as follows: warp threads of the bottom of the tape, core 28, synthetic monofilament 26, covering threads, possibly threads or thread for binding the arms of the Y.

The numeral 29 indicates a binding needle for the weft threads, this needle being so controlled as to execute in known manner a reciprocal movement along its own axis for the binding of the weft threads. It should be noted that the two weft threads 30 and 30*a*, picked simultaneously by the needles 23 and 23*a*, are bound together by means of the needle 29.

In the FIGS. 14 and 15 there can be noted the synthetic monofilament 26 fed as warp thread and the core 28, which, in the exemplifying form illustrated, has the appearance of a thin lamina solid with a fixed organ (not illustrated) of the loom on one side and, on the other side, for a certain section inserted into the edge of the slide fastener border which is being formed. The monofilament 26 is moved in a pre-determined sequence to opposite sides of the lamina 28 by means of the movement of a heddle (not illustrated) or any other organ forming part of the loom and connected to the heddle to cause it to execute the said movement.

To allow better comprehension of the method of manufacture of the slide fastener according to the FIG. 13, description will hereafter be given, with reference to the FIGS. 16 and 17, of two steps relating to the formation fo the edge of one of the supporting tapes with the simultaneous formation of the related row of linking elements obtained by starting from the pre-crimped synthetic monofilament 26 as in the first example described.

It should be noted that in the Figures from 16 to 21 and from 16*a* to 21*a*, there are indicated, at the edge of the supporting tape, three warp threads 31, 32, 33 destined to form the upper short arm of the Y-tape (upper covering of the meander) and three warp threads 34, 35, 36 destined to form the lower short arm of the Y-tape (lower covering of the meander).

In the FIGS. 16*a* and 17*a* there are indicated also certain warp threads for the formation of the bottom of the supporting tape. It is however understood that also in this case the number of the covering threads as also the number of threads for the formation of the tape, and also the particular textile plaiting, can be selected and varied at will depending on requirements.

In particular, it can be seen how the warp threads 31, 32, 33 form the upper shed and how the threads 34, 35, 36 form the lower shed to constitute together with the wefts 30 and 30*a* respectively the upper and lower coverings (FIGS. 16 and 17). However, as it is not essential for the comprehension of the present invention to give attention to the evolutions of the upper and lower covering threads or to the evolutions of the threads constituting the supporting tape, which in the FIGS. from 5 to 10 are reported solely as example of a particular plaiting, attention will instead be given to the evolution of the monofilament 26 around the lamina 28 and to the directions of picking of the two weft threads during the two steps of a complete run.

With reference to the sequences illustrated in the FIGS. from 18 to 21 and from 18*a* to 21*a*, it is seen how the desired effect of formation of the meander around the lamina 28 is in particular brought about by the combined action of the two sectors 27 and 27*a*, which oblige the monofilament 26 to bend itself around the lamina 28, and by the action of the weft threads (in the sequences of the FIGS. from 18 to 21, only the upper weft thread operates), which, once the monofilament has been bent, maintain it in position on withdrawal of the sectors 27 and 27*a* (see FIGS. 21 and 21*a*).

Figure 18:
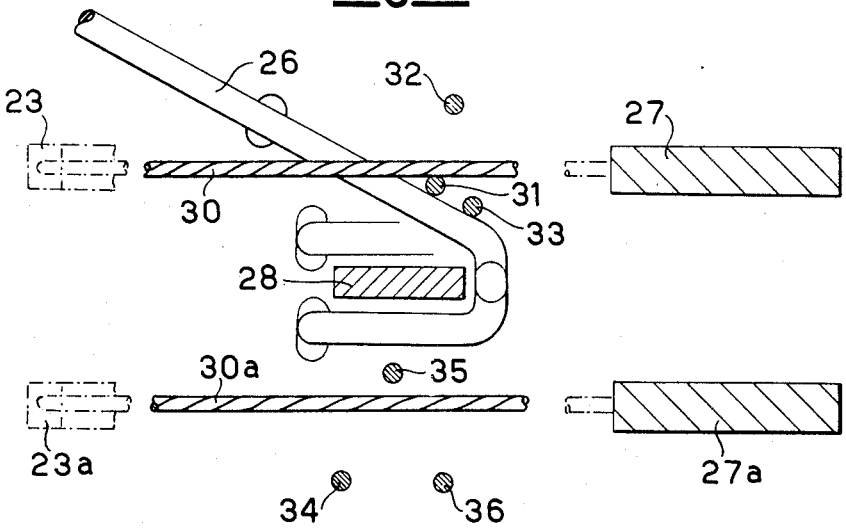
Figure 18A:
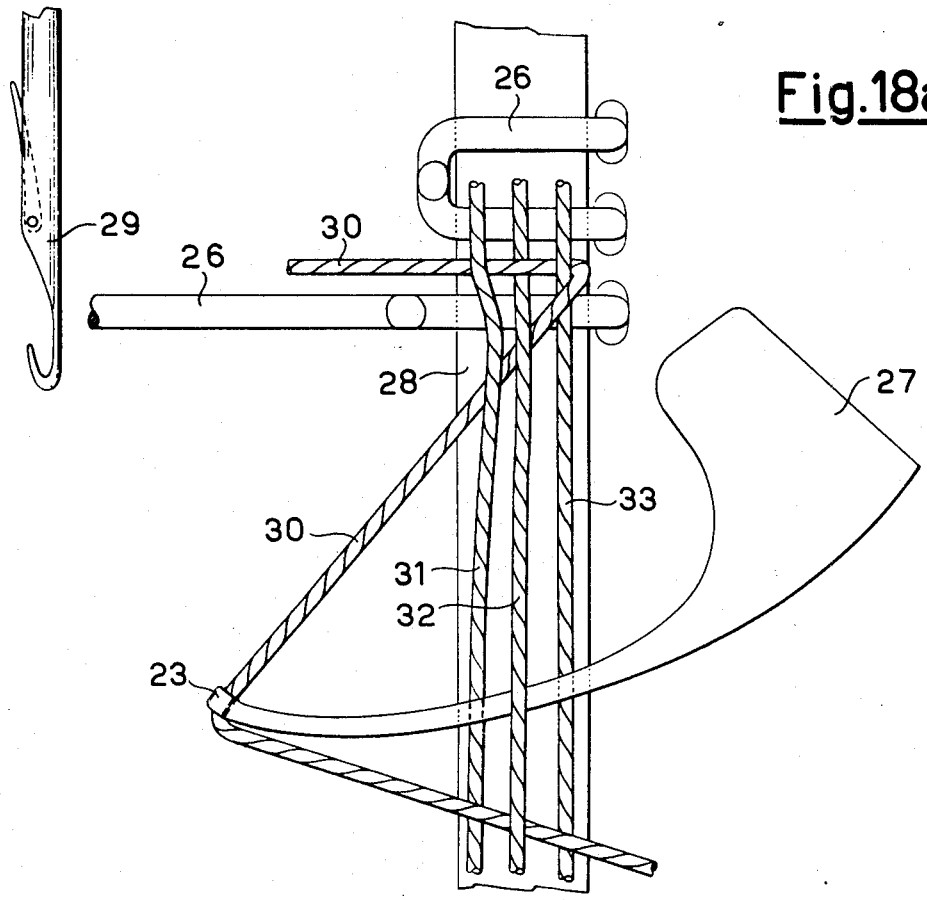

In the FIGS. 18 and 18*a* it is clearly seen how the weft threads 30 and 30*a* have just entered the respective upper and lower sheds, while the sectors 27 and 27*a* have not yet gone into action. In this step (which corresponds to that of the FIG. 16), the monofilament 26 comes from above and the weft thread 30, arriving from the previous pick above the monofilament, is now caused to pass under the said monofilament, plaiting with the covering threads 31, 32, 33 and bending the monofilament 26 against the lamina 28.

Figure 19:
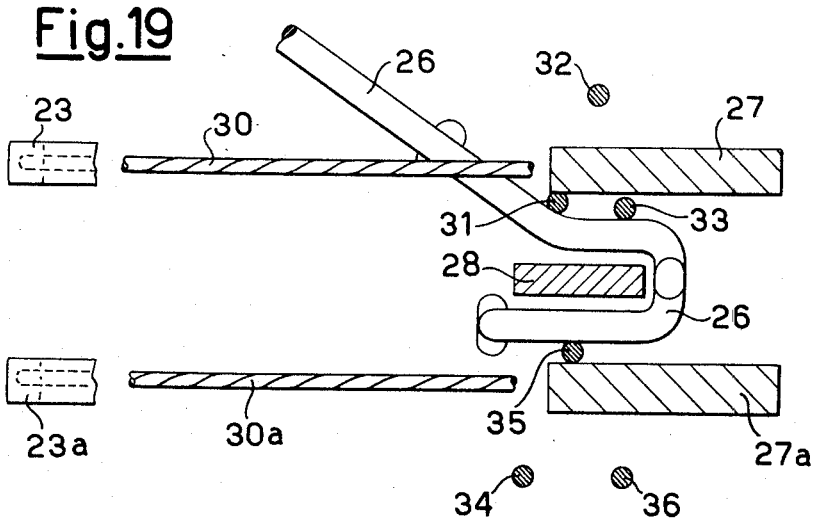
Figure 19A:
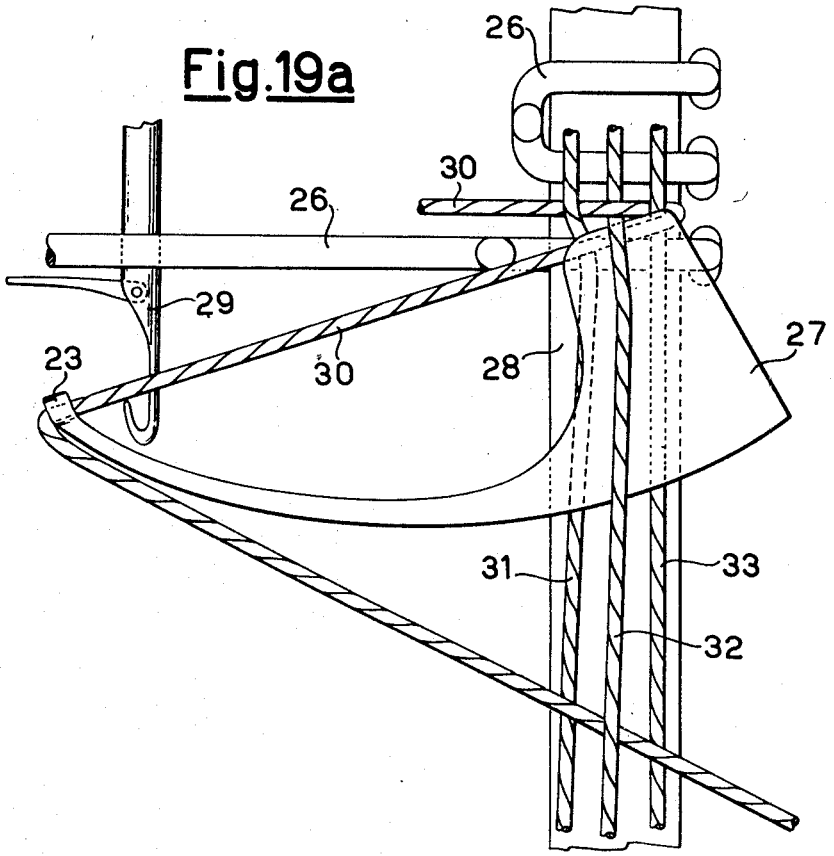
Figure 20:
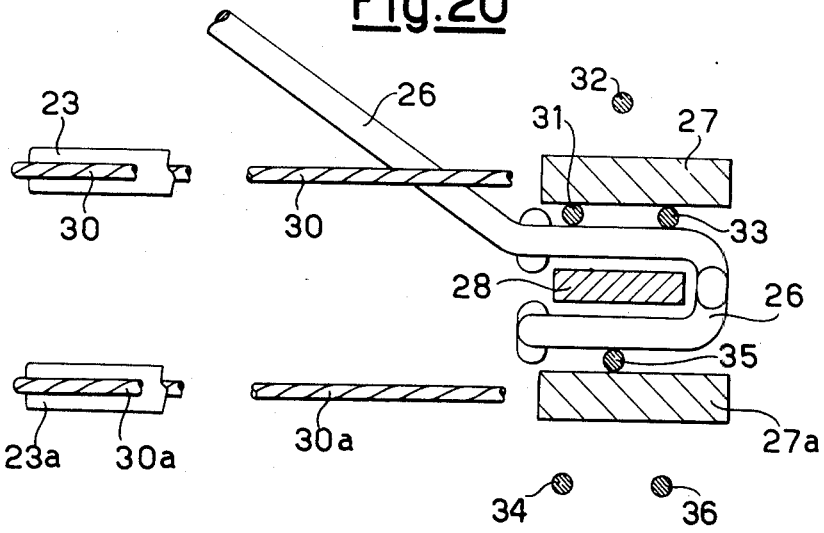
Figure 20A:
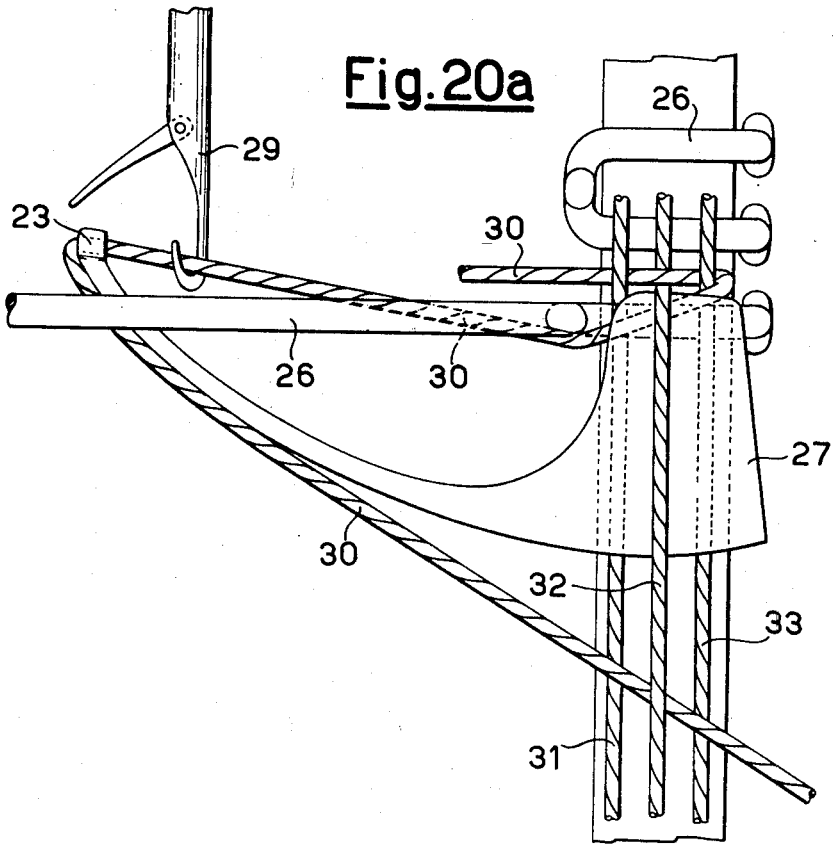

In the FIGS. 19 and 19*a*, it is seen how the sector 27 goes into action to continue the bending of the monofilament 26 around the lamina 28, a bending which terminates at the instant illustrated in the FIGS. 20 and 20*a*. In the FIG. 20*a*, it is also clearly seen how the weft thread 30 (together with the weft thread 30*a*, not visible) has been gripped by the binding needle 29.

At the instant illustrated in the FIGS. 21 and 21*a*, the two needles 23 and 23*a*, together with the related sectors 27, 27*a*, have again withdrawn, while the monofilament 26 is held bent by the weft thread 30. Immediately after the instant illustrated in the FIGS. 21 and 21*a*, the reed 25 beats the picked weft threads against the already formed fabric and subsequently the warp threads and the monofilament are brought into the position according to the FIG. 17.

There then commences another picking of weft threads and in this step the lower weft thread 30*a* and the sector 27*a* of the lower needle 23*a* operate to bend the monofilament 26.

It is clear that the distance between the two sectors 27 and 27*a*, and their length, affect the dimensions of the meander.

However, even in the absence of the two sectors 27, 27*a*, by means of the action of the weft threads 30, 30*a* during the picking movement, and of a calculated ratio between the tensions of these weft threads and the tension of the monofilament 26, it is possible to achieve the desired effect of forming of the meander, even though with a lower degree of dependability.

The foregoing description makes clear the concept behind the present invention.

It has in fact been seen that the formation of the meander starting from a monofilament pre-crimped at regular intervals takes place during the very weaving of the supporting tape with two-arm edge, by means of successive bendings or rotations of 180°, alternately in one direction and the other, of the monofilament around a core, with the aid also of the beating of the reed.

Since the pre-crimpings of the monofilament already represent starting points for the bending, a perfectly regular meander comes to be formed.

The form of the core is not decisive for the purposes of the actuation of this concept and, by way of example, use could also be made as core of an ordinary round or shaped wire, for example of steel or other material sufficiently rigid to bear the bending force of the monofilament.

In the case in which the core is also taken alternately to opposite sides of the shed, it is clear that the said core must be of a material sufficiently flexible to bear for a reasonable period of time the repeated flexures at the speed of modern needle-looms, such flexure being due to its travelling to the two extreme positions of the shed.

The core remains for a certain section inserted into the meander, inside the tubular edge of the supporting tape, and it gradually slips out during the formation of said edge.

It is also possible to fill the inner space of the meander with suitable threads, pledgets, monofilaments or the like, which can be fed continuously and in parallel with the core 26 or which could even substitute this latter, to remain incorporated in the edge of the supporting tape.

The execution of the slide fastener according to the FIG. 13 on a shuttle loom clearly presents difficulties of minor nature as compared with the execution on a needle-loom.

The two weft threads are in the former case picked by two distinct shuttles, though it is also possible to provide that one shuttle only causes the complete evolution for the formation of the Y-tape.

In this case the two sectors can be imagined as applied to the shuttles themselves, or else applied to any moved support—for example by the same mechanism as moves the shuttles.

When it is wished to realize a slide fastener of the type according to the FIG. 1, operating with two weft threads and providing for the inversion of these threads in a pre-determined sequence, it is possible to maintain immobile the core inserted in the tubular edge of the tape undergoing formation and cause the two weft threads to pass alternately above and below the core.

The FIGS. from 22 to 29 illustrate in schematic and exemplifying manner possible means of, and the methods that permit the effecting of, the inversion of the two weft threads by means of a weaving loom equipped with special needles or sickles for the picking of the weft threads.

In the FIGS. 22 and 23 there are visible the extremities of two needles 58, 59 which operate in two superimposed parallel planes, the direction of movement for the picking of the weft threads 51 and 52 being indicated by the arrow A. In the case of the FIG. 22, the extremities of the needles or paddles 58, 59 have a central slot 60, V-shaped, while in the case of the FIG. 23 the cavity 61 is formed by means of slantwise removal of one half of the terminal portion of the needle.

In the FIG. 24 it can be schematically seen how the two weft threads 51 and 52 each pass through the eyes 53 and 54 respectively of two heddles. The numerals 58 and 59 again indicate, in section, the two picking needles, while the numerals 56 and 57 indicate, also in section, two fixed striker bars, the purpose of which is to keep the weft threads 51, 52 in the optimal position for finding themselves exactly in the trajectories of the end slots of the needles which advance to perform the picking.

In the layouts indicated in the FIGS. from 25 to 29 illustration is given of the aforementioned elements and there have been left out of account all the parts which do not serve to explain the concept of picking of the wefts by means of needles which do not stably retain the respective weft threads. It is understood that the formation of the tubular-edge tape with simultaneous bending and binding of the synthetic monofilament to form the row of linking elements takes place conceptually in a manner similar to that heretofore described.

In the FIGS. 25–29 there is also visible the binding needle 62 and indication is given of the finished tape 63 formed by the plaiting of warp threads 65 with the weft threads 51, 52. Representation is also given of the synthetic monofilament 64 which forms the row of linking elements 66.

In FIG. 25, illustration is given of the step in which the needles 58, 59 start their movement of picking of the weft threads 51, 52.

The slots of the needles have not yet gripped the weft threads which are kept stretched by special weft-stretcher springs (per se known and not illustrated) and positioned by the eyes 53, 54 of the respective heddles and by the bars 56, 57.

In the FIGS. 26 and 27 there are visible the steps of commencement and completion of the movement of picking of the needles 58, 59, each of which has gripped the respective weft thread, appropriately positioned.

The FIG. 28 shows the step of commencement of the return movement of the needles 58, 59, the weft threads 51, 52 being retained by the binding needle 62.

Finally, in the FIG. 29 there is illustrated the final phase of the return movement of the needles 58, 59, the weft threads 51, 52 no longer being gripped by the said needles.

At this point it is possible to effect the inversion of the weft threads by appropriately controlling the heddles bearing the eyes 53, 54 so that at the start of the successive picking cycle the two weft threads 51 and 52 present themselves inverted before the frontal slots of the needles 58, 59.

The product obtained with this last method corresponds to the one illustrated in the FIG. 1, saving the possibility of improving the retention of the monofilament by providing for the inversion of the wefts not after every picking by interposing picks without prior inversion of the two weft threads.

The advantage of this method as compared with the method described with reference to the FIGS. from 5 to 12 is an increase of production owing to the picking of two weft threads at a time, and another advantage is the simplification achieved by not having to subject the core to a continuous bending stress.

The invention is not of course to be understood as limited to the examples of embodiment illustrated in detail in the present patent, but it is understood that within the framework of the present patent fall all those variants and modifications within the grasp of a person skilled in the art, which put the same fundamental concept into practice.

What is claimed is:

1. A method for manufacturing slide fasteners comprised of the steps of:

weaving a supporting tape from warp and weft threads and simultaneously forming one edge into a two-arm edge with the two-arms being spaced apart, feeding a synthetic monofilament which has been pre-crimped at regular intervals as a warp thread, weaving the monofilament into the two-arm edge of the supporting tape by inserting a flexible core member into the sapce between the two-arms and while forming the two-arm edge bending the monofilament back and forth around the core to form the monofilament into a continuous meander configuration having rearwardly positioned returns, leg portions covered, at least in part, by the fabric forming the two-arm edge and exposed U-loops which extend outwardly beyond the two-arm edge to act as linking elements to be coupled by the slide.

2. A method according to the claim 1, wherein the monofilament is bent around the core by bringing the monofilament, in a predetermined sequence, alternately to opposite sides of the shed formed by the warp threads and by regulating the ratio between the tensions of the weft threads and the tension of the monofilament.

3. A method according to the claims 1 or 2, wherein the core is brought in a pre-determined sequence, alternately to opposite sides of the shed formed by the warp threads, so that the monofilament and the core are periodically on opposite sides of the shed.

4. A method according to the claim 3, wherein the bending of the monofilament is completed through the instrumentality of supplementary means acting on the monofilament immediately after the picking of every weft thread.

5. A method according to the claim 1, wherein the supporting tape with two-arm edge is manufactured with the use of two weft threads operating in different weaving planes and that the position of these weft threads is inverted, in a predetermined sequence, from one to the other of said weaving planes.

6. A method according to the claim 5, wherein the inversion of the two weft threads is effected after every picking of the wefts.

7. A method according to the claim 5, wherein the inversion of the two weft threads is effected periodically after two pickings of the wefts.

8. A method of manufacturing a woven slide fastener comprised of a woven supporting tape having a two-arm edge on a loom having means for forming a shed from warp threads and a weft needle, the steps of simultaneously forming warp yarns and weft yarns into a two-arm edge, feeding a continuous synthetic monofilament, adapted to form a row of linking elements and pre-crimped at regular intervals, as a warp thread holding a core member between the arms of the two-arm edge, and alternately bringing, in a predetermined sequence, the monofilament to opposite sides of the shed in order to assume the form of a U-shaped meander being bent within the range of the weaving point around the core and weaving and binding the monofilament into the two-arm edge of the supporting tape during the weaving thereof, with the moving of the monofilament from positions on opposite sides of the shed around the core being parallel to the direction of the weft insertion to form the rearward return points of the meander so that the monofilament is bound to the two arms of the supporting tape with the legs of the meander being parallel to the direction of weft insertion.

9. A method according to claim 8, characterized by the fact that at each weft insertion the monofilament is moved in two immediately succeeding steps parallel to the direction of weft insertion.

10. A method according to claim 8, characterized by the fact that the core is also brought in a predetermined sequence alternately to opposite sides of the shed, so that the monofilament and the core are periodically on opposite sides of the shed.

* * * * *